US008376503B1

(12) United States Patent
Wu et al.

(10) Patent No.: US 8,376,503 B1
(45) Date of Patent: Feb. 19, 2013

(54) METHOD AND SYSTEM OF IN-DOCUMENT DETECTION OF WEAK OR MISSING INKJETS IN AN INKJET PRINTER

(75) Inventors: Wencheng Wu, Webster, NY (US); Beilei Xu, Penfield, NY (US); David A. Mantell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/227,299

(22) Filed: Sep. 7, 2011

(51) Int. Cl.
*B41J 29/393* (2006.01)

(52) U.S. Cl. ..... 347/19

(58) Field of Classification Search ..... 347/5, 9, 347/14, 15, 19
See application file for complete search history.

(56) References Cited

U.S. PATENT DOCUMENTS

| | | | |
|---|---|---|---|
| 5,210,547 | A | 5/1993 | Watanabe et al. |
| 6,572,213 | B2 | 6/2003 | Valero |
| 6,695,435 | B1 | 2/2004 | Cheng et al. |
| 7,039,348 | B2 | 5/2006 | Kerxhalli et al. |
| 7,382,507 | B2 | 6/2008 | Wu |
| 7,427,118 | B2 | 9/2008 | Mizes et al. |
| 2004/0027618 | A1 | 2/2004 | Nakamura et al. |
| 2008/0303854 | A1 | 12/2008 | Mizes et al. |
| 2009/0262380 | A1 | 10/2009 | Puigardeu et al. |
| 2010/0021069 | A1 | 1/2010 | Fan et al. |
| 2010/0123752 | A1 | 5/2010 | Eun et al. |
| 2010/0124362 | A1 | 5/2010 | Wu et al. |
| 2010/0238220 | A1 | 9/2010 | Yeh et al. |
| 2010/0245454 | A1 | 9/2010 | Ramakrishnan et al. |
| 2010/0253732 | A1 | 10/2010 | Sjolander et al. |
| 2012/0105529 | A1 * | 5/2012 | Powers et al. ..... 347/14 |

* cited by examiner

*Primary Examiner* — An Do
(74) *Attorney, Agent, or Firm* — Maginot, Moore & Beck, LLP

(57) ABSTRACT

A method enables the positions of inoperable inkjets in printheads to be corrected for positional changes arising from shifts in media, shrinkage of the media, thermal expansion of optical sensors that detect the inoperable inkjets, and other measurement errors. The measurement errors are detected with reference to image data corresponding to a reference pattern printed within a portion of a print job. Thus, reference marks do not need to be printed in areas outside of a print job as previously required.

24 Claims, 7 Drawing Sheets

METHOD AND SYSTEM OF IN-DOCUMENT DETECTION OF WEAK OR MISSING INKJETS IN AN INKJET PRINTER

TECHNICAL FIELD

This disclosure relates to imaging devices that generate printed images on an image receiving member with pixels of colorant, and more particularly, to imaging devices that identify missing pixels during the operation of the imaging device.

BACKGROUND

Imaging devices form images on image receiving members that include paper and other print media. Different imaging or printing techniques, which include laser printing, inkjet printing, offset printing, dye-sublimation printing, thermal printing, and the like, may be used to produce printed documents. In particular, inkjet imaging devices eject liquid ink from printheads to form images on an image receiving member. The printheads include a plurality of inkjets that are arranged in some type of array. Each inkjet has a thermal or piezoelectric actuator that is coupled to a printhead controller. The printhead controller generates firing signals that correspond to digital data for images. The printhead actuators respond to the firing signals by ejecting ink drops onto an image receiving member to form an ink image that corresponds to the digital image used to generate the firing signals. The size of the ink drops and the timing of the ejection of the ink drops are affected by the frequency and amplitude of the firing signals.

Throughout the life cycle of imaging devices, the image generating ability of the device requires evaluation and, if the images contain detectable defects, correction. Various defects in the image generating process affect ink image quality. In an inkjet printing system, one such defect occurs when an individual inkjet becomes inoperable as either a "weak" or "missing" inkjet. A weak inkjet intermittently ejects ink drops or ejects ink drops having a mass that is different than expected for the firing signal used to operate the actuator for the inkjet. A missing inkjet fails to eject ink drops entirely. Inoperable inkjets, including both weak and missing inkjets, negatively impact the quality of printed images.

Some existing printing systems are configured to detect and compensate for weak or missing inkjets. Identifying inoperable inkjets typically requires the printing of reference patterns, which are specially designed and arranged ink lines that are printed on the image receiving member. These reference patterns must be printed separately from the images printed as part of a print job. Consequently, the printing of reference patterns absorbs a portion of the resources to be used for productive printing. Because a printhead often includes hundreds or thousands of individual inkjets, correct identification of a single inoperable inkjet presents challenges. In some imaging devices, an optical sensor is used to generate image data of the reference pattern on an image receiving member and these data are analyzed and correlated to inkjet positions in a printhead to identify a weak or missing inkjet. Errors in the alignment of the photosensors in the optical sensor or in the calibration of the sensor along with distortions that arise from media shifting during operation of the printer affect the accuracy of the analysis of the image data. Consequently, improvements to the identification of weak or missing inkjets in an inkjet printer would be beneficial.

SUMMARY

In one embodiment, a method for identifying weak or missing inkjets in a printhead has been developed. The method includes detecting at least one inoperable inkjet in the printhead of the inkjet printer with reference to image data of a portion of a print job printed onto an image receiving member, identifying an offset for a position of the at least one inoperable inkjet; adjusting a position for the detected at least one inoperable inkjet with reference to the identified offset; and compensating for the detected at least one inoperable inkjet with reference to the adjusted position for the at least one inoperable inkjet.

In another embodiment, an inkjet imaging system that detects weak or missing inkjets has been developed. The system includes a plurality of printheads arranged in the inkjet imaging device to form a print zone in the inkjet imaging device, each printhead having a plurality of inkjets configured to eject ink, an optical sensor positioned between the print zone formed by the plurality of printheads and an exit for documents printed by the plurality of printheads, and a controller operatively connected to the plurality of printheads and to the optical sensor. The controller is configured to operate the plurality of printheads to eject ink onto an image receiving member as the image receiving member passes through the print zone in the inkjet imaging device, detect at least one inoperable inkjet in one of the printheads of the inkjet printer with reference to image data of a portion of a print job formed with ink ejected onto the image receiving member, identify an offset for a position of the at least one inoperable inkjet in the one printhead, adjust a position for the detected at least one inoperable inkjet with reference to the identified offset, and operate the printhead in which the detected at least one inoperable inkjet is located to compensate for the detected at least one inoperable inkjet with reference to the adjusted position for the at least one inoperable inkjet.

BRIEF DESCRIPTION OF THE DRAWINGS

The foregoing aspects and other features of a system and method that identify weak or missing inkjets in a printhead are explained in the following description, taken in connection with the accompanying drawings.

DETAILED DESCRIPTION

Figure 1:
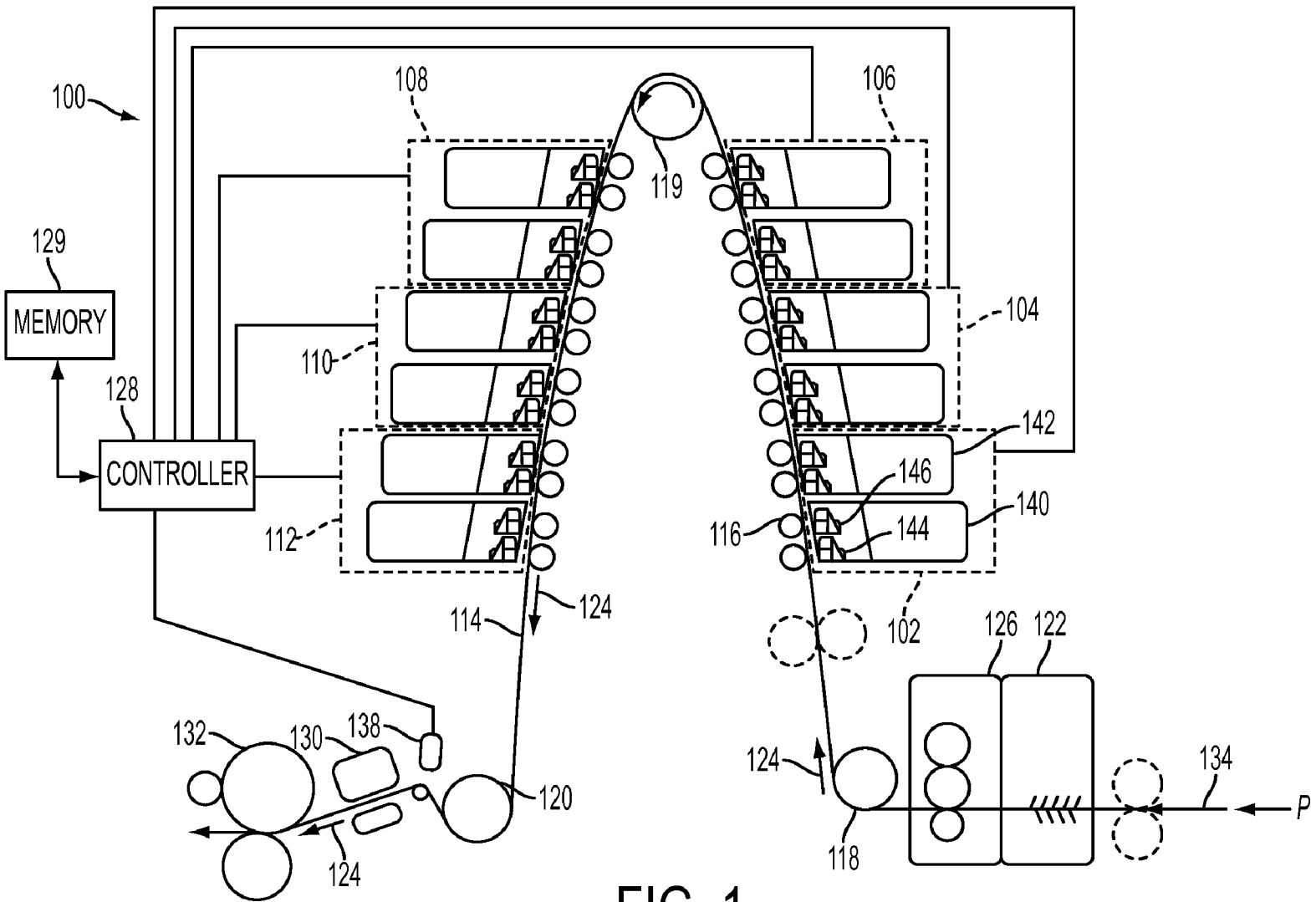
FIG. 1 is a schematic diagram of a continuous feed printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that forms a printed image on media. Examples of printers include, but are not limited to, digital copiers, bookmaking machines, facsimile machines, multi-function machines, or the like. The term "image receiving member" encompasses any print medium including paper, as well as indirect imaging members including imaging drums or belts. As used herein, the term "process direction" refers to a direction of travel of the image receiving member in the printer, and the term "cross-process direction" refers to a direction that is perpendicular to the process direction on the surface of the image receiving member. The terms "image" and "printed image" refer to any pattern of ink drops that a printer forms on the image receiving member. Examples of images include text and graphics in one or more colors that are printed on the image receiving member.

The term "page" refers to an area of the surface of an image receiving member that receives a printed image that corresponds to one page of a document. The term "document zone" as used herein refers to a portion of the page that receives printed images. An "inter-document zone" refers to a margin that separates document zones in two adjoining pages where the printer does not print images of a print job portion during a print job, but some printers print images of reference patterns in the inter-document zones. A continuous media web may have a plurality of pages formed on its surface with a predetermined space left between adjacent printed images of each page to facilitate cutting the web into individual sheets. These predetermined spaces are an example of inter-document zones. A single sheet of paper may have printed images corresponding to different pages formed on each side of the sheet.

FIG. 1 depicts an exemplary embodiment of a printer 100 that is configured to identify inoperable inkjets in one or more printheads. Printer 100 is a continuous web printer that includes six print modules 102, 104, 106, 108, 110, and 112; a media path 124 configured to accept a print medium 114, and a controller 128. The print modules 102-112 are positioned sequentially along a media path 124 and form a print zone for forming images on a print medium 114 as the print medium 114 moves past the print modules.

In printer 100, each print module 102, 104, 106, 108, 110, and 112 in this embodiment provides an ink of a different color. In all other respects, the print modules 102-112 are substantially identical. Print module 102 includes two print sub-modules 140 and 142. Print sub-module 140 includes two print units 144 and 146. The print units 144 and 146 each include an array of printheads that may be arranged in a staggered configuration across the width of both the first section of web media and second section of web media. Each of the printheads includes a plurality of inkjets in a configuration similar to the printhead 100 depicted in FIG. 1. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path 124 at a predetermined resolution.

Print sub-module 142 is configured in a substantially identical manner to sub-module 140, but the printheads in sub-module 142 are offset by one-half the distance between inkjet ejectors in the cross-process direction from the printheads in sub-module 140. The arrangement of sub-modules 140 and 142 enables a doubling of linear resolution for images formed on the media web 114. For example, if each of the sub-modules 140 and 142 emits ink drops at a resolution of 300 drops per inch (dpi), the combination of sub-modules 140 and 142 emits ink drops at a resolution of 600 dpi.

During operation, the media web 114 moves through the media path 124 in the process direction. The media web 114 unrolls from a source roll 152 and passes through a brush cleaner 122 and a contact roller 126 prior to entering the print zone. The media web 114 moves through the print zone past the print modules 102-112 guided by a pre-heater roller 118, backer rollers exemplified by backer roller 116, apex roller 119, and leveler roller 120. The media web 114 then passes through a heater 130 and a spreader 132 after passing through the print zone. The media web passes an exit guide roller 134 and then winds onto a take-up roller 154. The media path 124 depicted in FIG. 1 is exemplary of one media path configuration in a web printing system, but various different configurations may lead the web past different rollers and other components. Alternative media path configurations include a duplexing unit that enables the printer 100 to form ink images on both sides of the media web 114.

In one embodiment, the source roll 152 is a roll of printing paper that winds through the media path 124 as the media web 114. The paper provided at the source roll 152 includes a certain amount of moisture. The various heaters positioned in the media path 124 heat the media web, and the media web 114 shrinks due to evaporation of moisture from the media web 114. Additionally, the media web 114 may experience oscillation in the cross-process direction as the media web 114 engages the rollers positioned along the media path 124. In one embodiment, the media web 114 experiences oscillation with a magnitude of 30 μm at a frequency of 8 Hz. As described in more detail below, both shrinkage and oscillation of the media web 114 contribute to a cross-process offset between an apparent position of an inoperable inkjet identified from images formed on the media web and the actual position of the inoperable inkjet in the printer 100.

The printer 100 includes an optical sensor 138 that generates image data corresponding to light reflected from the media web 114 after the media web 114 has passed through the print zone. The optical sensor 138 is configured to detect, for example, the location, intensity, and/or location of ink drops jetted onto the receiving member by the inkjets of the printhead assembly. The optical sensor 138 also detects light reflected from unprinted portions of the media web 114. The optical sensor 138 includes an array of optical detectors mounted to a bar or other longitudinal structure that extends across the width of the media web 114 in the cross-process direction.

In one embodiment in which the media web 114 is approximately twenty inches wide in the cross process direction and the print modules 102-112 print at a resolution of 600 dpi in the cross process direction, over 12,000 optical detectors are arrayed in a single row along the bar in the optical sensor 138 to generate a single scanline across the image receiving member. The 12,000 optical detectors detect light corresponding to 12,000 pixels arranged on the surface of the image receiving member in the cross-process direction. The term "pixel" refers to one location in a grid-like pattern of potential locations where printed ink drops land on the image receiving member. In one embodiment, each optical detector generates a numeric value corresponding to the intensity of light reflected from one pixel on the image receiving member. The numeric value of the intensity corresponds to the amount of light reflected from the pixel, with a white image receiving member reflecting the most light to generate the highest numeric intensity value while a pixel filled with a black ink drop generates the lowest numeric intensity value.

The optical detector 138 detects a single row of pixels in the cross-process direction at one time, and detects successive rows of pixels as the media web 114 moves through the media path 124. The optical detectors are configured in association in one or more light sources that direct light towards the surface of the image receiving member. The optical detectors are arranged in the optical sensor 138 in a predetermined configuration in the cross-process direction. Consequently, the cross-process position of light reflected from the media web 114 can be identified with reference to the optical detector that detects the reflected light.

The optical sensor 138 detects a cross-process position of ink drops formed on the image receiving member 114, and the optical sensor 138 can also detect light streaks in printed images that correspond to an inoperable inkjet in one of the printheads that prints the image. The term "light streak" refers to a linear arrangement of pixels extending in the process direction on an image receiving member having an increased intensity level due to at least one inkjet corresponding to the pixels either failing to eject ink drops, or ejecting ink drops on an incorrect position of the image receiving member. The controller 128 identifies one printhead in the plurality of printheads that includes the inoperable inkjet with reference to printheads that formed the ink image that includes the light streak. In multi-color printing systems, each optical detector in the optical sensor 138 includes photodetectors that are selectively sensitive to red, green, and blue (RGB) light. Each optical detector records different amplitudes of reflected light detected by each of the RGB detectors, in addition to a sum of light received by all detectors to generate an RGB digital image of the ink image. The controller 128 can identify the color and corresponding printhead of an inoperable inkjet using the color image data.

A light streak indicates that an inkjet is inoperable, and the cross-process location of each optical detector in the optical sensor 138 corresponds to an inkjet in at least one of the printheads. Due to spatial distortions of the media web, lateral movement of the media web, and thermal expansion of the optical sensor 138, the inoperable inkjet may not correspond exactly to the optical detector that detects the light streak. In one example, web shrinkage near one edge of the media web 114 results in a two pixel wide offset in the cross-process direction between the apparent position of a light streak and the actual position of the inoperable inkjet. In another example, the entire media web oscillates in the cross-process direction and the magnitude and direction of the offset changes as the media web oscillates.

Some distortions on the media web are non-uniform and are referred to as "local" distortions. The magnitude of offset due to media web shrinkage is a local distortion that is greatest near the edges of the media web and decreases near the center of the media web. Other sources of offset affect the entire media web in a uniform manner and are referred to as "global" distortions. A cross-process oscillation of the media web 114 as the media web 114 moves past the optical sensor 138 is a global distortion that affects the entire media web uniformly, at least in the region around the optical sensor 138. In some configurations, multiple distortions including some or all of the distortions described above contribute to an offset between the apparent inoperable inkjet that is nominally aligned with the optical detector and an actual inoperable inkjet.

The controller 128 is configured to control various subsystems, components and functions of printer 100. The controller 128 is operatively connected to each of the printheads in the print modules 102-112 to control ejection of ink from each of the print modules 102-112. The controller 128 is also connected to the optical sensor 138 to receive image data that the optical sensor 138 generates from light reflected from the media web 114.

The controller 128 stores and retrieves data, including stored program instructions, held in a memory 129. Various embodiments of the memory 129 include volatile data storage devices, such as static and dynamic random access memory (RAM), as well as non-volatile data storage devices, which include magnetic and optical disks, solid-state storage devices including flash memory, and any other data storage device that is configured to store and retrieve data for the controller 128.

In various embodiments, controller 128 is implemented with general or specialized programmable processors that execute programmed instructions. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, and VLSI circuits.

Controller 128 is operatively coupled to the print modules 102-112 and controls the timing of ink drop ejection from the print modules 102-112 onto the media web 114. The controller 128 generates a plurality of electrical firing signals for the inkjets in each of the print modules 102-112. In one configuration, the controller 128 generates a predetermined sequence of firing signals for each of the printheads in the print modules 102-112 to generate reference pattern ink marks on the media web 114. In another configuration, the controller 128 receives data corresponding to one or more images in a print job. The controller 128 generates firing signals for the print modules 102-112 corresponding to the print job data to print images on the image receiving member 114.

In the printer 100, the controller 128 is configured to identify one or more inoperable inkjets by detecting light streaks in the image data of a portion of print job generated by the optical sensor 138. The controller 128 is further configured to identify a magnitude and direction of a cross-process direction offset between the apparent position of an inoperable inkjet in the image data and the actual position of the inoperable inkjet in the printhead. The controller 128 executes instructions stored in the memory 129 to implement one or more of the processes described herein to identify and compensate for distortion in the image data that affects the identification of the location of inoperable inkjets.

Figure 2:
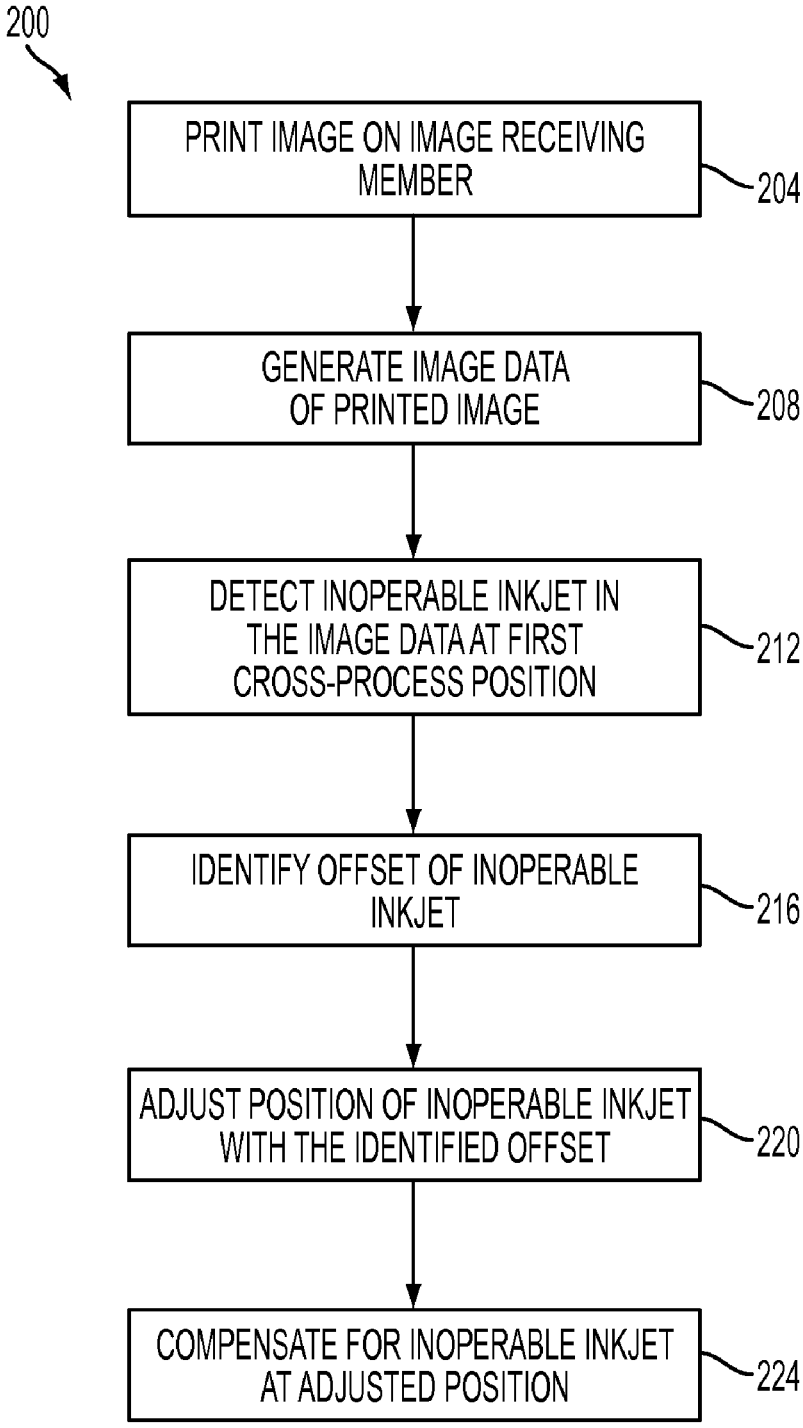
FIG. 2 is a block diagram of a process for identifying an inoperable inkjet in a printhead and for compensating for the inoperable inkjet.

FIG. 2 depicts a process 200 for identification and compensation of an inoperable inkjet in a printhead. Process 200 is described in conjunction with the printer 100 for illustrative purposes. In process 200, the printer 100 prints an image on the media web 114 (block 204). In one configuration, the printed image corresponds to a single page of a print job that includes various text and graphical elements.

The image receiving member with the printed image moves past an optical sensor that generates image data corresponding to the printed image on the image receiving member (block 208). In the printer 100, the optical sensor 138 generates image data for one or more rows of pixels arranged in the cross-process direction on the media web 114. Process 200 detects an inoperable inkjet at first cross-process position from the image data (block 212). In the embodiment of the printer 100, the controller 128 detects a light streak in the image data that indicates an inoperable inkjet. The cross-process position of the optical detector in the sensor 138 that generates the image data corresponding to the light streak indicates a first position of an inoperable inkjet in one of the printheads in the printer 100. The first identified position is referred to as an apparent position because various components in the printer including either or both of the media web 114 and the optical sensor 138 produce a cross-process direction offset between the apparent position of the inoperable inkjet in the image data and the actual position of the inoperable inkjet in a printhead.

Process 200 continues by identifying a magnitude and direction of the offset between the apparent position of the inoperable inkjet and the actual position of the inoperable inkjet (block 216). In one embodiment described in more detail in FIG. 3, the controller 128 identifies spatial distortions of the media web 114 and optical sensor 138 during initialization of the printer 100. During a print job, the controller 128 identifies the cross-process position of one edge of the media web 114 to serve as a reference location, and then identifies the offset of the inoperable ejector with reference to the measured distortions and the identified position of the edge of the media web 114. In another embodiment described in more detail in FIG. 5, the printer 100 prints a series of marks on the image receiving member while printing images in the print job. The marks are generated with a low-coverage pattern that is difficult for the naked eye to detect. The optical sensor 138 detects the marks and the controller 128 identifies a cross-process direction offset from the predetermined cross-process positions of the inkjets that form the pattern and the identified cross-process positions of the marks from the image data.

Process 200 adjusts the position of the identified inoperable inkjet from the first cross-process position of the inoperable inkjet in the image data with reference to the identified offset (block 220). In some embodiments, the first position and the adjusted position of the inoperable inkjet are indexed as a number of pixels extending across the image receiving member.

Figure 7:
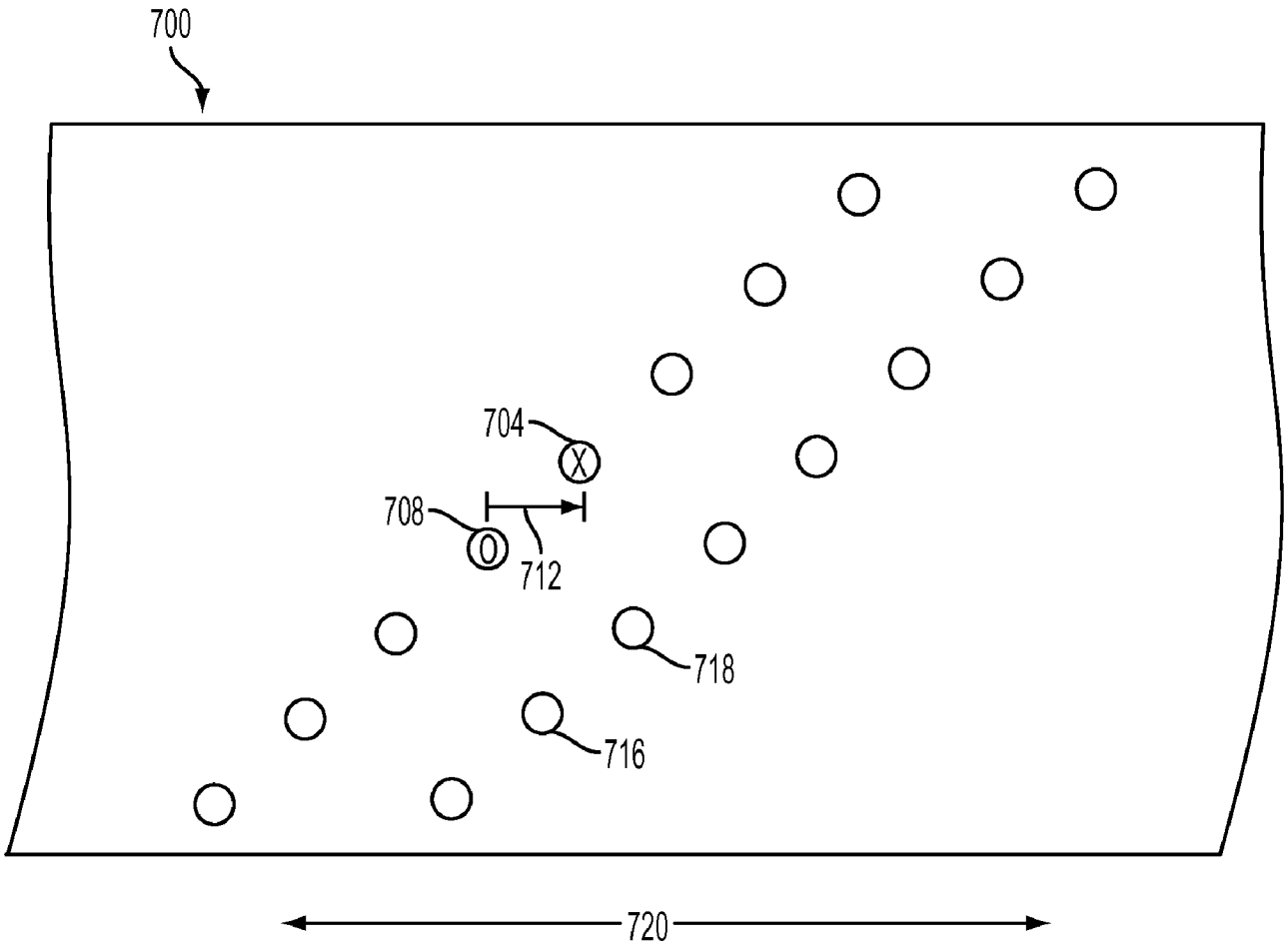
FIG. 7 is a schematic diagram of inkjets in a printhead.

As depicted in FIG. 7, an exemplary printhead 700 includes a plurality of inkjets arranged in the cross-process direction 720. In printhead 700, inkjet 704 is inoperable, but the image data generated from printed images produced by the printhead 700 include a light streak at the pixel location corresponding to the operating inkjet 708. Process 200 identifies the correct inoperable inkjet 704 using the identified position corresponding to the ejector 708 adjusted by an offset 712. The offset 712 is two pixels to the right as viewed on the face of the printhead 700. The adjusted pixel position of the inoperable inkjet corresponds directly to the inoperable inkjet 704.

After identifying the inoperable inkjet, process 200 operates one or more printheads to compensate for the inoperable inkjet (block 224). In one configuration, the controller 128 compensates for the inoperable inkjet by operating adjacent inkjets 716 and 718 to reduce or eliminate the light streak and does not generate signals to operate the inoperable inkjet. In another configuration, inkjets in one or more different printheads in the printer that are aligned with the inoperable inkjet 704 in the cross-process direction eject ink drops to reduce or eliminate light streaks and other image artifacts caused by the inoperable inkjet 704. In some alternative embodiments, a printhead maintenance process revives the inoperable inkjet, or the printer generates an alert to request serviced or replacement of the printhead with the inoperable inkjet.

Figure 3:
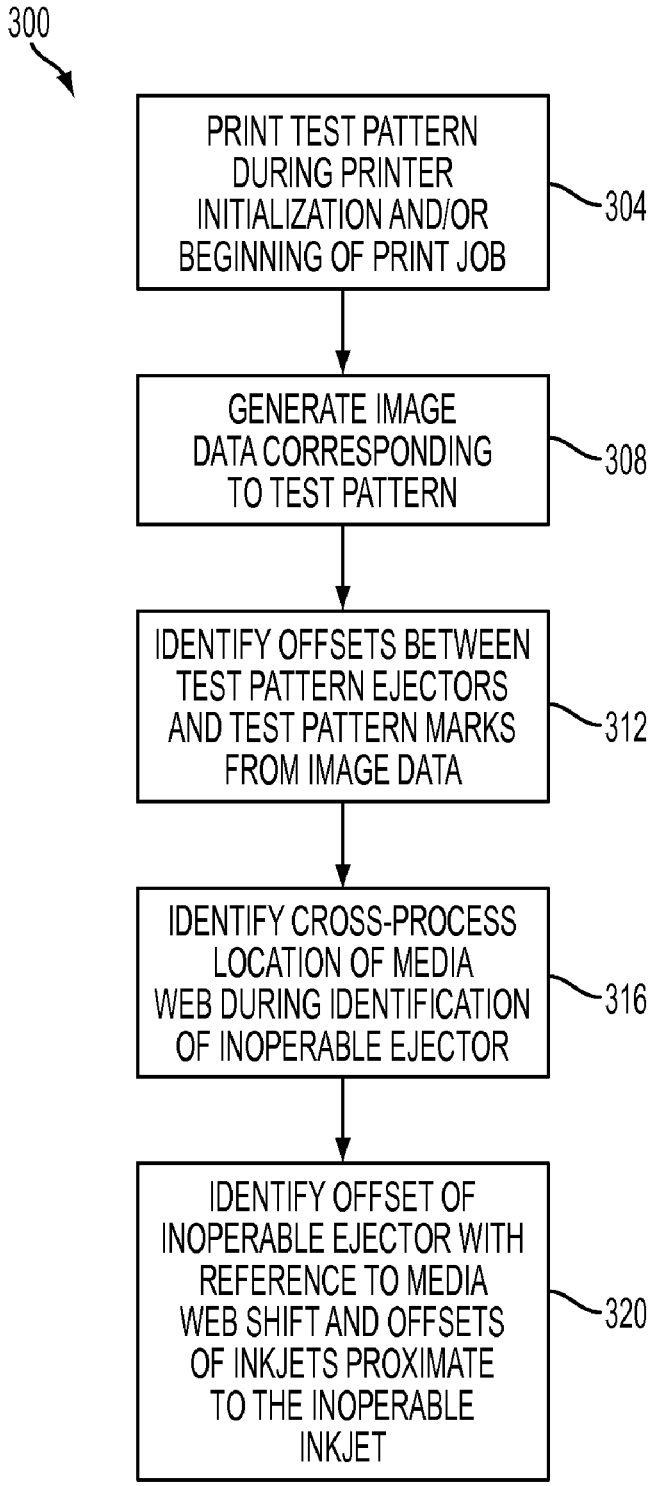
FIG. 3 is a block diagram of a process for identifying an offset of the inoperable inkjet identified in FIG. 2.

FIG. 3 depicts a process 300 for identifying the offset between an apparent cross-process position of an inoperable inkjet as identified in image data generated from the image receiving member and the cross-process position of the inoperable inkjet in a printhead. Process 300 is described in conjunction with the printer 100 for illustrative purposes. In process 300, the printer 100 prints a reference pattern on an image receiving member during either or both of initialization of the printer 100 and prior to commencing a print job (block 304).

Figure 4:
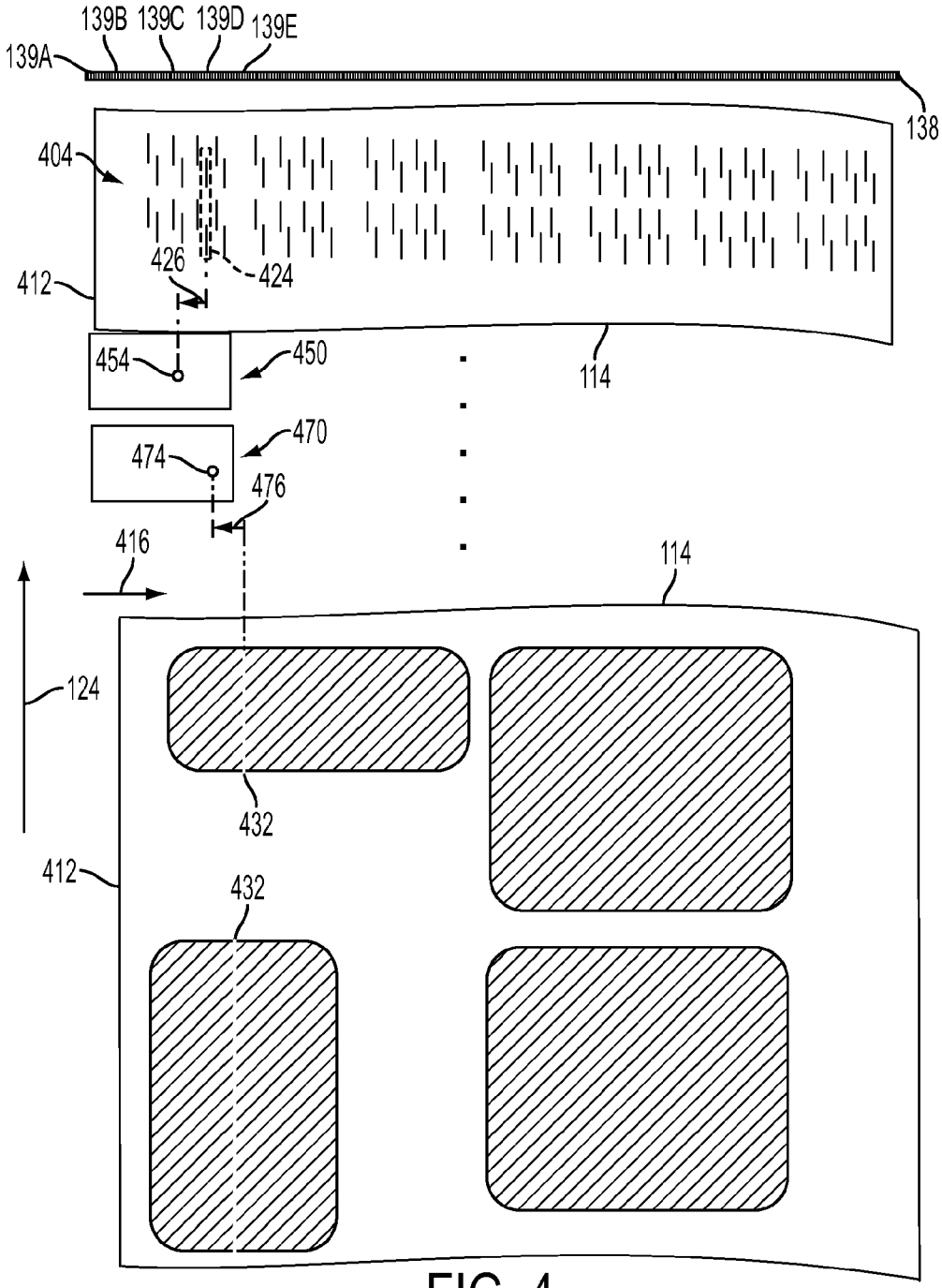
FIG. 4 is a plan view of a media web with a reference pattern and printed images.

FIG. 4 depicts an example reference pattern 404 printed on the media web 114 and images printed on the media web 114 with an inoperable inkjet as described in process 300. The reference pattern 404 includes marks, which are depicted as a plurality of dashes in FIG. 4, generated by a selected set of inkjets in some or all of the printheads in the printer 100. A printhead 450 that prints a portion of the reference pattern 404 includes an ejector 454. The printhead 450 and ejector 454 have a predetermined position in the cross-process direction. The ejector 454 ejects ink drops to form a series of dashes 424 on the media web 114 as part of the reference pattern 404. The printer 100 prints the reference pattern 404 or another suitable reference pattern on the media web 114 with the images of a print job.

In one embodiment, the reference pattern 404 is printed as a "top of form" (TOF) reference pattern in an inter-document zone that precedes each copy of a document in a print job. As used in this document, the TOF reference pattern refers to a reference pattern printed on the media web at a location that is proximate to one edge of a printed sheet after the sheet is cut from the media web. Examples of TOF reference patterns include patches or lines formed with black ink near one edge of the page after the page is cut from the media web. In one embodiment, the printer forms a TOF reference pattern as small rectangular black patches or bar codes that are located just outside the top-left corner of a printed page form, which is referred to as the top of the form. The TOF is formed outside of the area of the media sheet containing the printed image, and the portion of the cut sheet that contains the TOF is trimmed during the final finishing process. In addition to use with process 300, the printer 100 uses the TOF to identify pages and to match first and second side images for printed pages on the media web 114.

Process 300 generates image data corresponding to the printed reference pattern on the image receiving member (block 308). In the printer 100, the optical sensor 138 generates image data as the media web 114 and reference pattern 404 move past the optical sensor. In FIG. 4, an optical detector 139C is aligned with the inkjet 454 in the cross-process direction, but due to distortions in the media web 114 and optical detector 138, a different optical detector 139D detects the light reflected from the dashes 424. Another optical detector 139A identifies the cross-process location of an edge 412 of the media web 114 as a reference to identify an expected cross-process distance between the edge 412 of the media web 114 and the dashes 424.

Process 300 identifies cross-process offsets between the marks in the reference pattern and the predetermined cross-process locations of the inkjets that print the reference pattern marks on the image receiving member (block 312). In the printer 100, thermal expansion of the optical sensor 138 and distortions in the media web 114, such as web shrinkage, generate an offset between the cross-process position of dashes identified in the reference pattern 404. An offset 426 separates the inkjet 454 and the identified cross-process position of the dashes 424 that the inkjet 454 prints on the media web 114. In one embodiment, the offset 426 is measured as a number of pixels in the cross-process direction. For example, the number of pixels between optical detector 139D and the optical detector 139C that is aligned with the predetermined position of the inkjet 454 represent a measurement of the offset 426. The offset between various inkjets and the corresponding positions of dashes in the image data varies for different inkjets due to local distortions of the media web 114 and the optical sensor 138. In the printer 100, the controller 128 is configured to store each of the identified offset values in the memory 129 in association with the cross-process position of each associated inkjet. The stored offset values are calibrated at the time the printer prints the reference pattern 404 to identify the offset of inoperable inkjets that are detected during a subsequent print job.

Process 300 continues during a print job as the printer forms ink images on the image receiving member. The printer detects an inoperable inkjet in image data generated from the printed image as described above in process 200. Process 300 identifies a cross-process location of an edge of the media web as the inoperable inkjet is identified in the image data (block 316). In FIG. 4, an inoperable inkjet 474 in a second printhead 470 results in a light streak 432 formed through printed images on the media web 114 during the print job. In the example of FIG. 4, the second printhead 470 did not produce the reference pattern 404, but is aligned with printhead 450 in the cross-process direction. A controller in the printer 100 identifies the printhead 470 that includes an inoperable inkjet from the image data generated by the optical detector 139E. A second optical detector 139B detects the edge 412 of the media web 114 at substantially the same time as the detection of the light streak 432. The identified cross-process position of the edge 412 media web 114 serves as a reference that reduces or eliminates the effects of media web oscillations that occur between the printing of the reference pattern 404 and the detection of an inoperable inkjet.

Process 300 identifies the offset in the image data in the cross-process direction with respect to lateral shifts in the media web and the offsets stored for inkjets that are proximate to the inoperable inkjet (block 320). The lateral movement of the media web 114 is a global distortion that changes the reference used to identify the inoperable inkjet. For example, in FIG. 4, the media web shifts right in direction 416 by a distance of five pixels in the time between the printing of the reference pattern 404 and the detection of the light streak 432. The stored offsets for one or more inkjets that are located near the inoperable inkjet provide offset data corresponding to local distortions in the media web 114 and the sensor 138. In the example of FIG. 4, dashes in the reference pattern 404, which includes the dashes 424, are positioned proximate to the cross-process position of the light streak 432.

In the printer 100, the controller 128 generates an average local offset using the stored offset data for one or more inkjets that are proximate to the light streak, such as inkjet 454. The controller 128 may generate an average offset value for several inkjets located near the light streak 432. The controller identifies the offset 476 as the net sum of the average offset of the inkjets proximate to the light streak 432 with the identified lateral offset of the entire media web 114. The offset data also specify a positive or negative value, corresponding to either a left or right offset in the cross-process direction as depicted in FIG. 4. Using the example offsets in FIG. 4, the average offset of surrounding inkjets is eight pixels left in the cross-process direction, while the lateral movement of the media web 114 is five pixels right in the cross-process direction. The resulting net offset 476 is three pixels to the left between the cross-process position of the optical detector 139E and the cross-process position of the inoperable inkjet 474. Process 200 uses the generated offset value to identify the offset 476 in the image data to determine the inkjet 474 that failed to operate and hence for the light streak. Once the inoperable inkjet is accurately identified, the controller compensates for the inoperable inkjet 474 by operating other inkjets that eject ink drops in the vicinity of the light streak in the image data.

Figure 5:
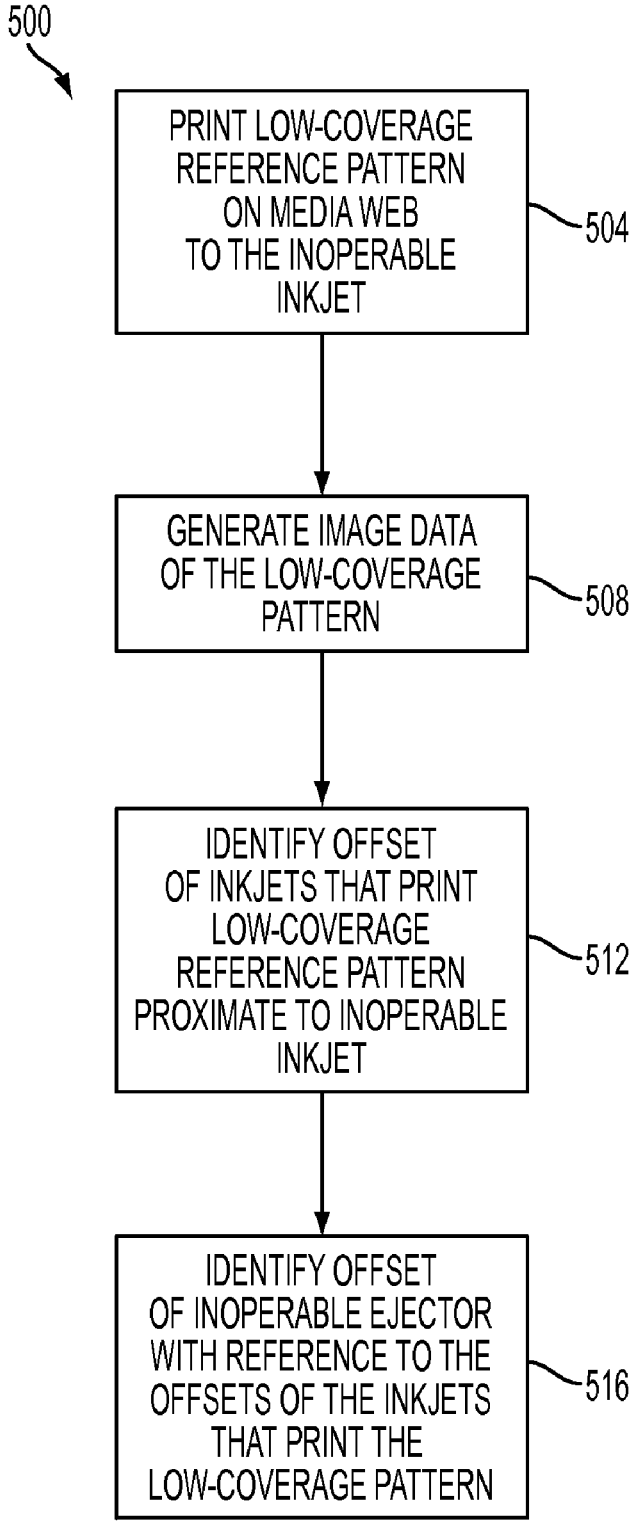
FIG. 5 is a block diagram of another process for identifying the offset of the inoperable inkjet identified in FIG. 2.

FIG. 5 depicts another process 500 for identifying the offset between a cross-process position of an inoperable inkjet identified with reference to the image data of the image receiving member and the cross-process position of the inoperable inkjet in the printhead. Process 500 is described in conjunction with the printer 100 for illustrative purposes. In process 500, the printer 100 prints a low-coverage pattern on a region of the media web that is proximate to the inoperable inkjet (block 504).

The low-coverage patterns are formed by printing ink drops in a low density pattern on the image receiving member to form marks that the optical sensor 138 detects but are difficult to perceive with the naked eye. In one example, low-coverage patterns include a plurality of dashes that are formed with an ink drop density of less than 20%. For example, a dash that is forty pixels in length in the process direction formed from two ink drops printed at intervals over the length of the dash has a density of 5%. The low coverage patterns are printed on the image receiving member with portions of the print job without producing a noticeable degradation in the quality of the printed print job images. In a CMYK color printer embodiment that prints on white paper, the yellow printheads print the low-coverage patterns since yellow ink is more difficult for the human eye to perceive. The identified offsets between the yellow dashes printed in the reference pattern and the known positions in the yellow printhead of the inkjets that ejected the yellow drops in the dashes are used to identify the offsets for inoperable inkjets in printheads of any color in the printer. In situations where an inkjet in a yellow printhead is inoperable, the printer ejects additional yellow ink drops from operating yellow ejectors, or can select printheads ejecting a different color, such as cyan, to print the low-coverage patterns.

Figure 6:
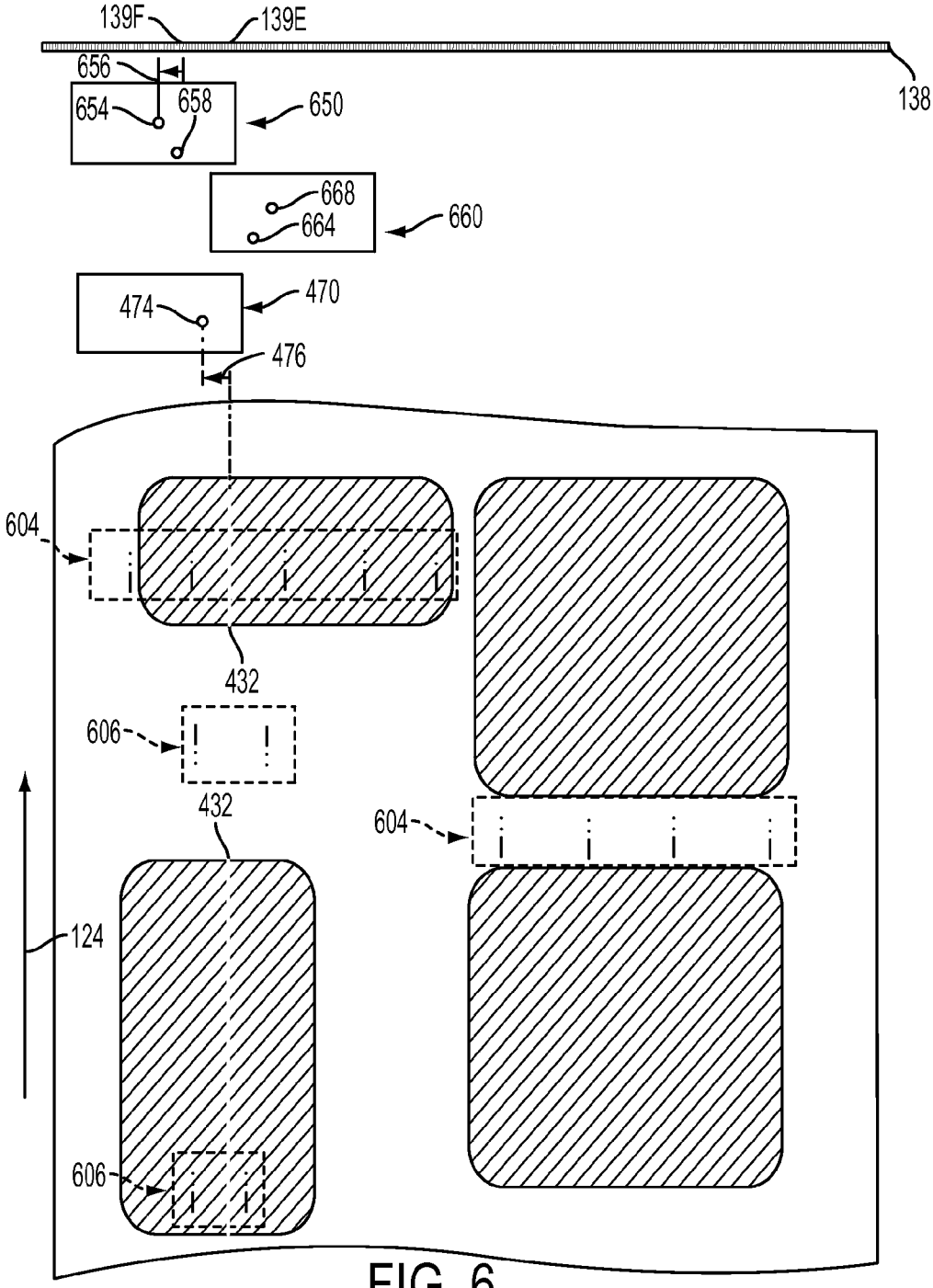
FIG. 6 is a plan view of a media web with printed images and registration marks printed concurrently with the printed images.

FIG. 6 depicts low coverage patterns printed on the media web 114 and images printed on the media web 114 with an inoperable inkjet as described in process 500. FIG. 6 depicts two alternative configurations of the low-coverage patterns. In one configuration, the printer 100 prints a low-coverage reference pattern 604 at regular intervals such in the document zone for each page of a print job. Printer 100 prints the marks in the low-coverage reference pattern 604 across the media web 114 without regard to inoperable inkjets. When an inoperable inkjet is identified, the marks in the low-coverage reference pattern 604 that are proximate to the inoperable inkjet are used to identify the offset of the inoperable inkjet. In the example of FIG. 6, some of the marks in the low-coverage reference pattern are printed over the printed images on the media web 114, while other marks are printed between images within the page. The process-direction position of each mark in the low-coverage reference pattern is selected to enable the optical detector 138 to detect the mark while the mark remains difficult to detect with the naked eye.

In another configuration, the low-coverage patterns are printed in response to the identification of an inoperable inkjet. In FIG. 6, the optical sensor 138 generates image data corresponding to the light streak 432 of an inoperable inkjet 474. The printer 100 operates inkjets 654 and 658 in printhead 650 and inkjets 665 and 668 in printhead 660 to form low-coverage patterns 606 on the media web 114. The low-coverage patterns 606 are printed proximate to the light streak 432 in the cross-process direction in the document zone to enable the optical detector 138 to identify local distortions of the media web 114 around the light streak 432. The printer 100 prints the low coverage patterns 606 in portions of the document zone on the media web 114 where the contrast between the ink in the pattern and the ink corresponding to the content in the document is low. In some embodiments, the low-coverage patterns 606 are printed on subsequent pages of a print job after a light streak corresponding to an inoperable inkjet is detected in the image data. The printer 100 detects the inoperable inkjet, prints the low-coverage reference pattern, and identifies the position of the inoperable inkjet over the course of one or more pages in a print job.

Process 500 generates image data of the low-coverage patterns printed on the media web (block 508) and identifies offsets of the inkjets that print the low-coverage patterns (block 512). In the printer 100, the optical detector 138 detects the low-coverage patterns 604 or 606. Process 500 identifies an offset between each mark in the low-coverage pattern and the corresponding inkjet that printed the mark. For example, inkjet 654 in printhead 650 is located at a predetermined position in the cross-process direction. An optical detector 139F in the optical sensor 138 detects the low-coverage pattern that the inkjet 654 prints on the media web 114. The offset 656 is the separation between the optical detector 139F and the inkjet 654 in the cross-process direction. As described above, the offset can be measured in terms of pixels. The controller 128 in the printer 100 identifies offsets for two or more inkjets that are proximate to the light streak 432, such as offsets for inkjets 658, 664, and 668.

Process 500 identifies an offset of the inoperable inkjet using the identified offsets for the inkjets that printed the low-coverage pattern on the image receiving member (block 516). The inkjets that print the low-coverage pattern are proximate to the inoperable inkjet to account for offset due to local distortions in the media web 114 and the optical sensor 138. Additionally, the printer 100 prints the low-coverage patterns close in time to detection of the light streak in the image data. Consequently, lateral oscillations of the media web 114 have minimal effect on the measured offsets since the low-coverage patterns are printed within a short time before or after detection of the light streak 432. In the printer 100, the controller 128 generates an average value of the offset for the inkjets that print the low-coverage pattern on the media web 114, such as inkjets 654, 658, 664, and 668. Process 200 uses the generated offset value to identify the offset 476 of the inoperable inkjet 474 and compensates for the inoperable inkjet 474.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of identifying inoperable inkjets in a printhead of an inkjet printer comprising:

detecting at least one inoperable inkjet in the printhead of the inkjet printer with reference to image data of a portion of a print job printed onto an image receiving member;

identifying an offset for a position of the at least one inoperable inkjet;

adjusting a position for the detected at least one inoperable inkjet with reference to the identified offset; and compensating for the detected at least one inoperable inkjet with reference to the adjusted position for the at least one inoperable inkjet.

2. The method of claim 1, the offset identification further comprising:

identifying the offset with reference to a plurality of ink drops ejected as a reference pattern within a document zone of the image receiving member.

3. The method of claim 2 wherein the offset is identified in response to the detection of the at least one inoperable inkjet.

4. The method of claim 2 further comprising:

ejecting the plurality of ink drops in the reference pattern with a plurality of inkjets arranged in a cross-process direction in a single printhead.

5. The method of claim 4 further comprising:

ejecting with each inkjet in the plurality of inkjets arranged in the cross-process direction a plurality of ink drops in a process direction that is orthogonal to the cross-process direction.

6. The method of claim 4 wherein the ink drops ejected by the plurality of inkjets arranged in the cross-process direction are yellow ink drops.

7. The method of claim 2 further comprising:

identifying the inkjets to eject the plurality of ink drops in the reference pattern with reference to image content used to print the portion of the print job on the image receiving member.

8. The method of claim 2 further comprising:

ejecting the plurality of ink drops into a next document zone on the image receiving member in response to the detection of the at least one inoperable inkjet.

9. The method of claim 8 further comprising:

selecting at least one inkjet to eject the plurality of ink drops into the next document zone with reference to the detected at least one inoperable inkjet.

10. The method of claim 9, the selection of the inkjet further comprising:

selecting the at least one inkjet from a printhead that ejects ink having a color that is different from a color of ink ejected by the detected at least one inoperable inkjet.

11. The method of claim 2, the ejection of the plurality of ink drops for the reference pattern further comprising:

ejecting the plurality of ink drops for the reference pattern with an ink drop density below a predetermined threshold.

12. The method of claim 11, the predetermined threshold being a 20% ink drop density.

13. The method of claim 1, the identification of the offset further comprising:

adjusting a calibrated offset with reference to a predetermined mark on the document zone prior to a start of the print job.

14. The method of claim 13 wherein the predetermined mark is a top of form mark on the image receiving member.

15. An inkjet imaging device comprising:

a plurality of printheads arranged in the inkjet imaging device to form a print zone in the inkjet imaging device, each printhead having a plurality of inkjets configured to eject ink;

an optical sensor positioned between the print zone formed by the plurality of printheads and an exit for documents printed by the plurality of printheads; and a controller operatively connected to the plurality of printheads and to the optical sensor, the controller being configured (1) to operate the plurality of printheads to eject ink onto an image receiving member as the image receiving member passes through the print zone in the inkjet imaging device, (2) to detect at least one inoperable inkjet in one of the printheads of the inkjet printer with reference to image data of a portion of a print job formed with ink ejected onto the image receiving member, (3) to identify an offset for a position of the at least one inoperable inkjet in the one printhead, (4) to adjust a position for the detected at least one inoperable inkjet with reference to the identified offset, and (5) to operate the printhead in which the detected at least one inoperable inkjet is located to compensate for the detected at least one inoperable inkjet with reference to the adjusted position for the at least one inoperable inkjet.

16. The device of claim 15, the controller being further configured:

to identify the offset with reference to a plurality of ink drops ejected as a reference pattern within another portion of the print job formed with ink ejected onto the image receiving member.

17. The device of claim 16, the controller being further configured:

to identify the inkjets to eject the plurality of ink drops in the reference pattern with reference to image content used to print the portion of the print job on the image receiving member.

18. The device of claim 16, the controller being further configured:

to operate one of the printheads in the plurality of printheads to eject the plurality of ink drops into another portion of the print job formed by ink ejected onto the image receiving member in response to the detection of the at least one inoperable inkjet.

19. The device of claim 18, the controller being further configured:

to select at least one inkjet to eject the plurality of ink drops into another portion of the print job formed with the ink drops ejected onto the image receiving member with reference to the detected at least one inoperable inkjet.

20. The device of claim 19, the controller being further configured:

to select the at least one inkjet from a printhead that ejects ink having a color that is different from a color of ink ejected by the detected at least one inoperable inkjet.

21. The device of claim 15, the controller being further configured:

to identify the offset with reference to a plurality of ink drops ejected as a reference pattern within the portion of the print job formed with ink ejected onto the image receiving member.

22. The device of claim 21 wherein the offset is identified in response to the detection of the at least one inoperable inkjet.

23. The device of claim 15, the controller being further configured:

to adjust a calibrated offset stored in a memory operatively connected to the controller with reference to a predetermined mark on the image receiving member prior to a start of the print job.

24. The device of claim 23 wherein the predetermined mark is a top of form mark on the image receiving member.

* * * * *